US008162234B2

(12) United States Patent
Wesselmeier

(10) Patent No.: US 8,162,234 B2
(45) Date of Patent: Apr. 24, 2012

(54) NOZZLE ARRANGEMENT FOR CREATING A WATER JET

(75) Inventor: Reinhard Wesselmeier, Hörstel-Riesenbeck (DE)

(73) Assignee: OASE GmbH, Hörstel-Riesenbeck (DE)

( * ) Notice: Subject to any disclaimer, the term of this patent is extended or adjusted under 35 U.S.C. 154(b) by 516 days.

(21) Appl. No.: 12/050,976

(22) Filed: Mar. 19, 2008

(65) Prior Publication Data

US 2008/0230130 A1 Sep. 25, 2008

(30) Foreign Application Priority Data

Mar. 23, 2007 (DE) ..... 10 2007 014 629

(51) Int. Cl.
*B05B 17/08* (2006.01)

(52) U.S. Cl. ..... 239/17; 239/22

(58) Field of Classification Search ..... 239/16, 239/17, 22, 290, 291, 548, 558, 589, 596, 239/597

See application file for complete search history.

(56) References Cited

U.S. PATENT DOCUMENTS

| | | | | |
|---|---|---|---|---|
| 2,366,354 | A * | 1/1945 | Robbins | 239/428.5 |
| 3,330,486 | A * | 7/1967 | Semple | 239/428.5 |
| 3,533,553 | A * | 10/1970 | Britzman | 239/17 |
| 3,684,175 | A * | 8/1972 | Hruby, Jr. | 239/22 |
| 3,749,311 | A * | 7/1973 | Hruby, Jr. | 239/17 |

FOREIGN PATENT DOCUMENTS

GB 495 915 A 11/1938

* cited by examiner

*Primary Examiner* — Davis Hwu

(74) *Attorney, Agent, or Firm* — Gudrun E. Huckett

(57) ABSTRACT

A nozzle arrangement for generating a water jet has a nozzle plate having a nozzle opening. In order for the nozzle arrangement to be able to generate a water jet that provides improved utilization as a light guide also in bodies of water with wave motion and that is constructively simple and producible in an inexpensive way, it has a nozzle sleeve that surrounds the nozzle opening at least partially and is arranged on the nozzle plate and is provided with an inner sleeve wall surface that surrounds a water jet exiting from the nozzle opening at a safety spacing. The safety spacing prevents unwanted contact with the water jet.

7 Claims, 3 Drawing Sheets

NOZZLE ARRANGEMENT FOR CREATING A WATER JET

BACKGROUND OF THE INVENTION

The invention relates to a nozzle arrangement for generating a water jet comprising a nozzle plate having a nozzle opening. The invention further relates to a fountain jet generator comprising such a nozzle arrangement.

Such nozzle arrangements are known. The water jet is ejected from the nozzle opening into an area that is visible for a viewer. The water jet should have a flow that is free of turbulence and air bubbles as much as possible so that it can be used as a light guide. In particular in cases in which the fountain jet generator is designed to be primarily hidden underneath the water surface and the water surface can have at least a slight wave motion, it is known to extend the nozzle opening at least to the level of the maximum wave motion and to allow it to project from the water surface. In this way it is to be prevented the waves of the body of water will act on the water jet and cause turbulence in the water jet. A disadvantage of such nozzle arrangements is however that in the area of the extension turbulence and air bubbles are produced within the water jet that are partially caused by friction between the water jet and the extension of the nozzle opening and partially by van der Waals forces between the water jet and the extension of the nozzle opening. They interfere with the utilization of the water jet as a light guide.

It is an object of the invention to provide a nozzle arrangement of the aforementioned kind that can produce even in bodies of water having a wave motion a water jet with improved utilization as a light guide and that is constructively simple and producible in an inexpensive way.

SUMMARY OF THE INVENTION

The invention solves this object by a nozzle arrangement of the aforementioned kind comprising a nozzle sleeve surrounding at least partially the nozzle opening and arranged on the nozzle plate and having an inner sleeve wall surface that surrounds a water jet exiting from the nozzle opening at a safety spacing. The safety spacing prevents an unwanted contact of the inner sleeve wall surface with the water jet.

The invention solves this object in regard to a fountain jet generator in that the fountain jet generator comprises such a nozzle arrangement.

By providing a nozzle sleeve that is arranged on the nozzle plate and surrounds at least partially the nozzle opening and has an inner sleeve wall surface that surrounds the water jet exiting from the nozzle opening at a safety spacing, it is achieved that the water jet exiting from the nozzle opening is protected by the nozzle sleeve from waves and, at the same time, the water jet, by maintaining a safety spacing relative to the inner sleeve wall surface, is prevented from contacting the wall surface so that no turbulence as a result of friction and/or van der Waals forces can result. The safety spacing is selected such that an unwanted contact between the water jet and the sleeve wall surface is prevented. The spacing, inter alia, depends on the shape, the size and the flow velocity of the water as well as the shape and length of the sleeve nozzle. The safety spacing is essentially defined by the spacing of the nozzle opening relative to the inner sleeve wall surface.

Advantageously, the nozzle arrangement has an air supply to a sleeve interior that is surrounded by the inner sleeve wall surface and through which the water jet passes. The sleeve interior is formed by the space in the interior of the nozzle sleeve through which the water jet passes plus the space that is provided by the safety spacing between the sleeve wall surface and the water jet. The air supply prevents the generation of vacuum in the area between the inner sleeve wall surface and the water jet. Such a vacuum can be generated by entrainment of air in the interior of the nozzle sleeve at a high speed of the water jet. The vacuum can be so strong that the water jet is sucked against the inner sleeve wall surface causing turbulence and air bubbles.

In a preferred embodiment of the invention the air supply is ensured by an air supply passage that connects the interior of the sleeve with an air reservoir. The air supply passage enables in a simple way a targeted guiding of air entering the sleeve interior. Advantageously, the air reservoir is the ambient air wherein the air supply passage ends with its first end in the ambient air and with the second end in the sleeve interior.

In an advantageous embodiment of the invention, the air supply passage is connected by means of an air supply opening in the inner sleeve wall surface with the sleeve interior. With this configuration additional elements for introducing the air into the sleeve interior are not needed so that material is saved while the air supply is reliably ensured.

The spacing between the air supply opening and the nozzle plate is smaller than or identical to the spacing of the nozzle opening to the inner sleeve wall surface. In this way it is ensured that pressure compensation with the ambient is realized directly above the nozzle plate. It is especially preferred that the air supply opening opens immediately above the nozzle plate.

The air supply passage in an advantageous embodiment of the invention is at least formed partially as a pipe that is circumferentially closed. This configuration ensures a controlled guiding of the air streams.

The nozzle opening is preferably circular. In this way, the boundary surface between the water jet and the ambient air after the water jet exits from the nozzle opening is minimized so that the smallest possible friction is ensured. In this way, the generation of turbulence and air bubbles in the water jet is minimized.

In an advantageous embodiment of the invention, the nozzle sleeve and the nozzle plate are formed together as an integral part. In this way, a simple and inexpensive manufacture of the nozzle arrangement as an injection-molded part is possible.

The nozzle sleeve and/or the sleeve interior that is delimited by the inner sleeve wall surface have preferably a cylindrical shape with a cross-sectional diameter that is greater than the diameter of the nozzle opening.

Advantageously, the safety spacing is sized sufficiently so that air can flow permanently through the sleeve exit into the sleeve interior even as the water jet exits from the nozzle opening and a sleeve exit of the nozzle sleeve. Air that is entrained by the water jet is therefore replaced constantly by air flowing in through the sleeve exit so that no vacuum between the water jet and the inner sleeve wall surface is generated that would be sufficient to suck the water jet against the inner sleeve wall surface. In this way, the generation of turbulence and air bubbles in the water jet as a result of friction of the water jet on the inner sleeve wall surface is effectively prevented.

BRIEF DESCRIPTION OF THE DRAWINGS

Further details and advantageous embodiments of the invention result from the dependent claims and the schematically illustrated embodiments explained in the following. It is shown in:

DESCRIPTION OF PREFERRED EMBODIMENTS

Figure 1:
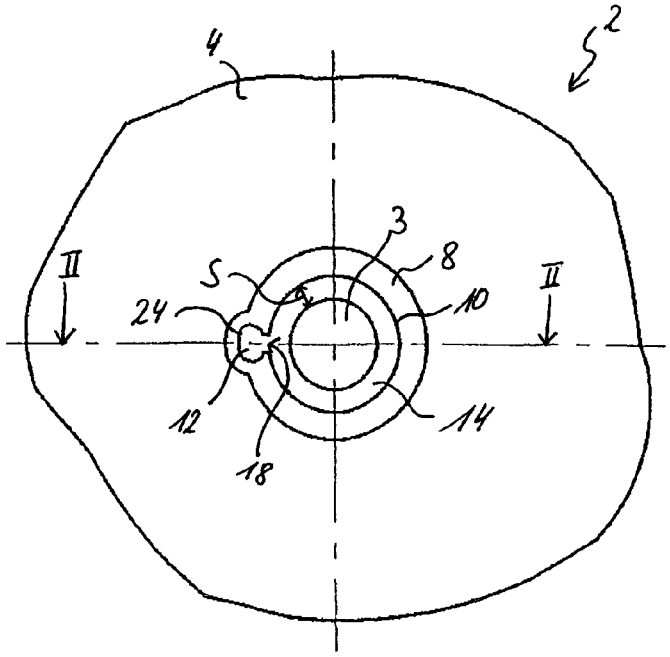
FIG. 1 a nozzle arrangement in accordance with the invention in a plan view.

In the following, parts that act in the same way are identified with identical reference numerals.

Figure 2:
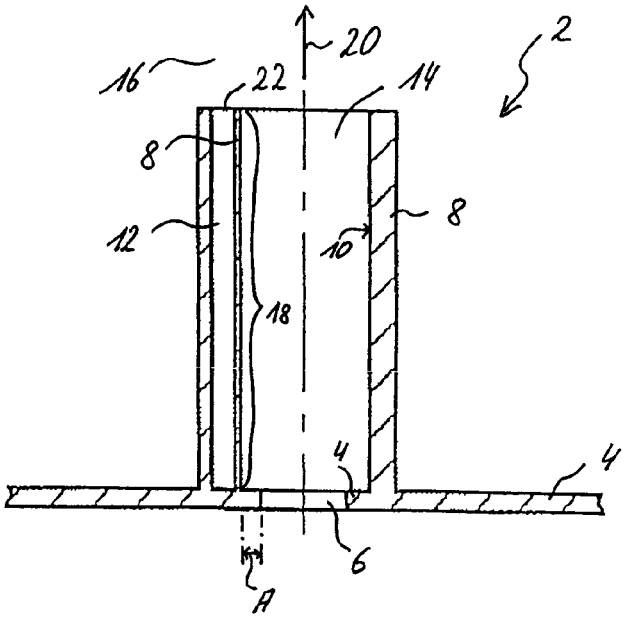
FIG. 2 the object of FIG. 1 in a sectioned side view along line II-II.

FIGS. 1 and 2 show a first nozzle arrangement 2 according to the invention for generating a water jet 3, comprising a nozzle plate 4 provided with a nozzle opening 6. The water jet 3 is not shown in the section views of FIGS. 2 and 4. The nozzle arrangement 2 has a nozzle sleeve 8 surrounding the nozzle opening 6 like a collar and having an inner sleeve wall surface 10. The inner sleeve wall surface 10 surrounds the water jet 3 exiting from the nozzle opening 4 at a safety spacing S that is defined ideally by the spacing A of the inner sleeve wall surface 10 relative to the nozzle opening 4. As a result of the safety spacing an unwanted contact of the water jet 3 at the inner sleeve wall surface 10 is prevented.

The nozzle arrangement 2 has an air supply passage 12 that connects a sleeve interior 14, that is surrounded by the inner sleeve wall surface 10 and through which the water jet 3 can pass, with an air reservoir 16. In the embodiment, the air reservoir 16 is provided by the ambient air outside of the nozzle arrangement 2. The air supply passage 12 is connected by air supply opening 18 to the sleeve interior 14 defined by the inner sleeve wall surface 10.

The spacing B between the air supply opening 18 and the nozzle plate 4 is smaller than the spacing A of the nozzle opening 6 to the inner sleeve wall surface 10. In the embodiment, the spacing B is 0 cm because the gas supply opening 18 extends to the nozzle plate 4. The air supply opening 18 of the air supply passage 12 extends in the inner sleeve wall surface 10 in the flow direction of the water jet 3, illustrated by arrow 20, to the end 22 of the nozzle sleeve 8. Moreover, the air supply opening 18 extends parallel to the longitudinal axis of the nozzle arrangement 2 that, in the illustrated embodiment, corresponds to the flow direction 20. In this way, a simple manufacture of the nozzle arrangement 2 as an injection-molded part is possible without additional mold slides. The air supply passage 12 is formed by a formed recess 24 in the inner sleeve wall surface 10 and is limited by the nozzle sleeve 8. This configuration enables a constructively simple and at the same time safe guiding and supplying of ambient air to the sleeve interior 14.

Figure 3:
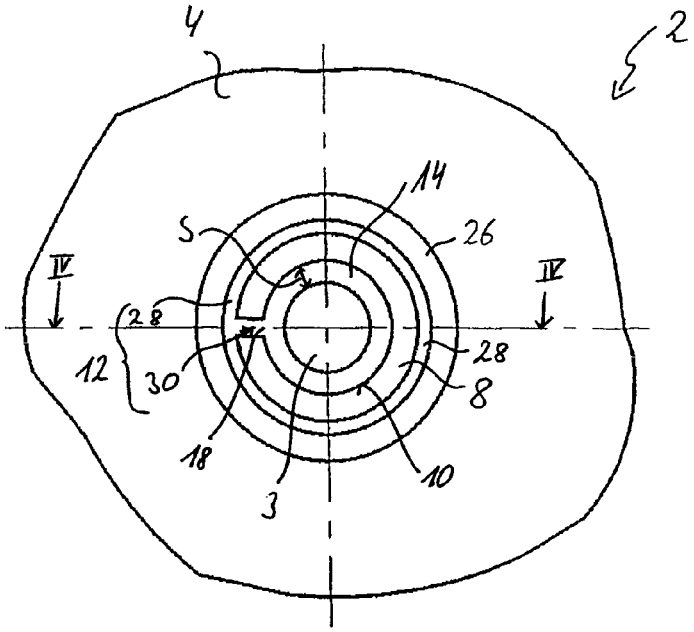
FIG. 3 a further nozzle arrangement according to the invention in a plan view.
Figure 4:
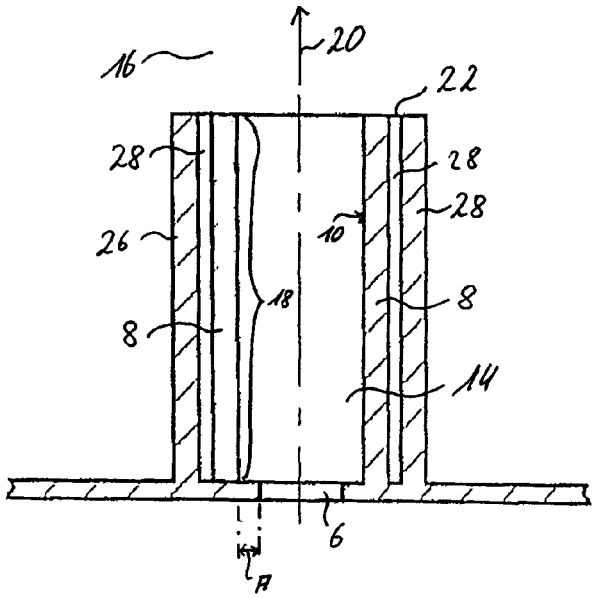
FIG. 4 the object of FIG. 3 in a sectioned side view along line IV-IV.

FIGS. 3 and 4 show an alternative embodiment of the air supply passage 12. The nozzle arrangement 4 has an outer nozzle sleeve 26 surrounding an inner nozzle sleeve that corresponds to the afore described nozzle sleeve 8; however, it is spaced circumferentially by intermediate space 28 from the inner nozzle sleeve 8. In this connection, the air supply passage 12 is partially formed by the intermediate space 28 and moreover by a passage 30 in the inner nozzle sleeve 8. The outer nozzle sleeve 28 and the inner nozzle sleeve 8 have preferable the shape of a cylinder wall, respectively.

The intermediate space 28 is not limited in the direction of the longitudinal extension 20 of the nozzle arrangement 2 which corresponds to the flow direction 20. In this way, a simple manufacture of the nozzle arrangement 2 as an injection-molded part is possible.

Figure 5:
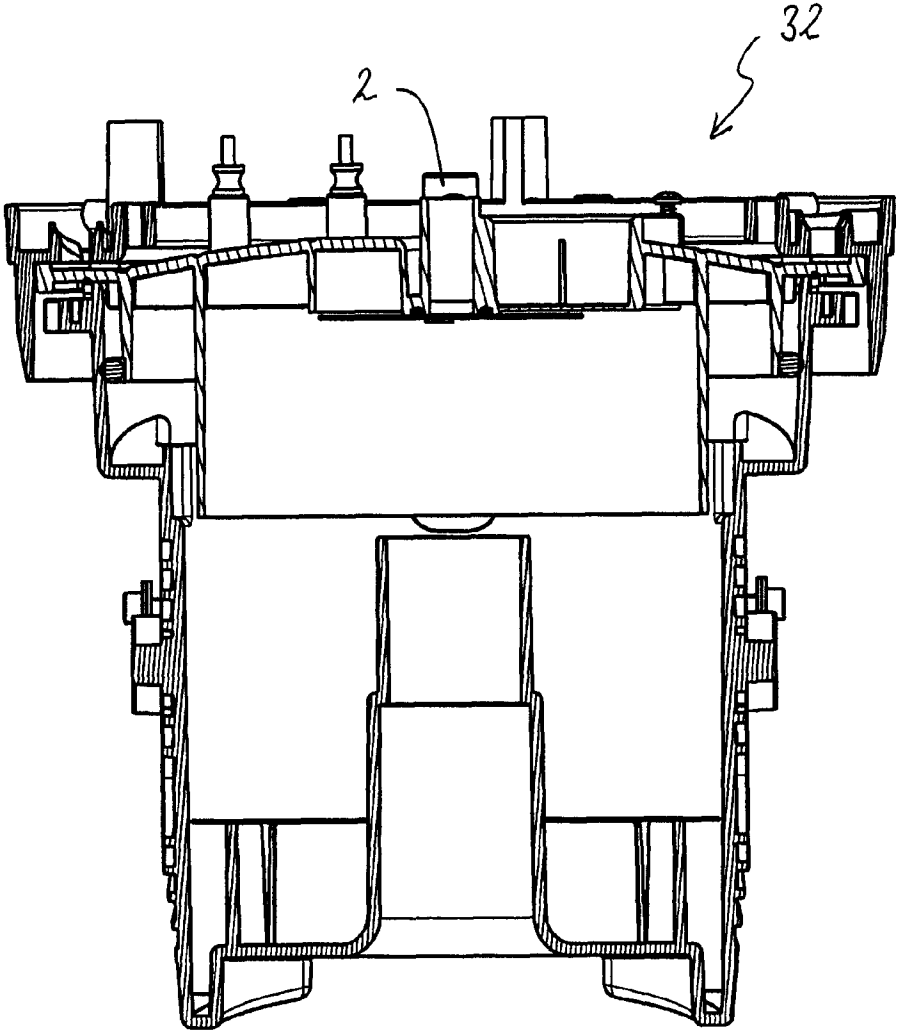
FIG. 5 a fountain jet generator according to the invention.

FIG. 5 shows in a sectioned side view a fountain jet generator 32 according to the invention with the nozzle arrangement 2 in accordance with the present invention.

The specification incorporates by reference the entire disclosure of German priority document 10 2007 014 629.0 having a filing date of Mar. 23, 2007.

While specific embodiments of the invention have been shown and described in detail to illustrate the inventive principles, it will be understood that the invention may be embodied otherwise without departing from such principles.

What is claimed is:

1. A nozzle arrangement for generating a water jet, the nozzle arrangement comprising:

a nozzle plate having a nozzle opening;

a nozzle sleeve arranged on the nozzle plate and surrounding at least partially the nozzle opening;

wherein the nozzle sleeve has an inner sleeve wall surface that defines a sleeve interior and that directly surrounds a water jet exiting from the nozzle opening at a safety spacing, which safety spacing prevents an unwanted contact of the inner sleeve wall surface with the water jet passing through the sleeve interior in an axial direction of the nozzle sleeve;

an air supply comprising an air supply passage connecting the sleeve interior to an air reservoir, wherein the air supply passage has an air supply opening provided in the inner sleeve wall surface and wherein the air supply passage is connected by the air supply opening to the sleeve interior;

wherein the air supply opening extends axially in the inner sleeve wall surface so as to begin at a spacing relative to the nozzle plate and end at an axial end of the nozzle sleeve located axially opposite the nozzle plate, wherein said spacing of the air supply opening relative to the nozzle plate is smaller than or identical to a spacing of the nozzle opening to the inner sleeve wall surface.

2. The nozzle arrangement according to claim 1, wherein the air supply passage is formed by a formed recess in the inner sleeve wall surface and is delimited by the nozzle sleeve.

3. The nozzle arrangement according to claim 1, further comprising an outer nozzle sleeve that circumferentially surrounds the inner nozzle sleeve at a spacing, wherein an intermediate space is defined between the inner and outer nozzle sleeves, wherein the air supply passage is formed at least partially by the intermediate space.

4. The nozzle arrangement according to claim 3, wherein the intermediate space is not limited in a longitudinal direction of the nozzle arrangement.

5. The nozzle arrangement according to claim 1, wherein the air supply passage is at least partially configured as a pipe that is closed circumferentially.

6. The nozzle arrangement according to claim 1, wherein the safety spacing is sufficiently sized such that, even for a water jet exiting from the nozzle opening and from a sleeve exit of the nozzle sleeve, air flows permanently through the sleeve exit into the sleeve interior.

7. A fountain jet generator comprising a nozzle arrangement according to claim 1.

* * * * *